United States Patent [19]

Mulock-Bentley

[11] 4,332,291

[45] Jun. 1, 1982

[54] HEAT EXCHANGER WITH SLOTTED FIN STRIPS

[75] Inventor: Desmond Mulock-Bentley, Johannesburg, South Africa

[73] Assignee: D. Mulock-Bentley and Associates (Proprietary) Limited, Johannesburg, South Africa

[21] Appl. No.: 106,020

[22] Filed: Dec. 21, 1979

[51] Int. Cl.[3] ..... F28D 1/04

[52] U.S. Cl. ..... 165/76; 165/153

[58] Field of Search ..... 165/152, 153, 183, 151, 165/76

[56] References Cited

U.S. PATENT DOCUMENTS

| | | | |
|---|---|---|---|
| 1,215,793 | 2/1917 | Gabrielson | 165/152 |
| 1,421,546 | 7/1922 | Parkin | 165/152 |
| 1,906,077 | 4/1933 | Modine | 165/152 |
| 2,252,211 | 8/1941 | Seemiller | 165/152 |
| 2,703,226 | 3/1955 | Simpelaar | 165/153 |

FOREIGN PATENT DOCUMENTS

| | | | |
|---|---|---|---|
| 974507 | 9/1975 | Canada | 165/153 |
| 2913134 | 10/1979 | Fed. Rep. of Germany | 165/183 |
| 1258111 | 12/1961 | France | 165/183 |
| 747341 | 11/1974 | South Africa | 165/153 |
| 754456 | 6/1975 | South Africa | 165/152 |
| 827062 | 2/1960 | United Kingdom | 165/152 |

OTHER PUBLICATIONS

Ser. No. 353,344/Beck/Heat Exchange Device of the Lamellate Type/5-25-43.

*Primary Examiner*—Sheldon J. Richter

*Attorney, Agent, or Firm*—Stevens, Davis, Miller & Mosher

[57] ABSTRACT

A heat exchanger such as a liquid-to-gas heat exchanger of the type used in natural-draught cooling towers and other industrial applications comprises a series of flattened conduits with fins between them, the fins being strips located in grooves of the opposed surfaces of two adjacent conduits. Each fin strip has a flat central zone and longitudinal edge zones turned through an angle relatively to the flat central zone. Numerical parameters for an optimized heat exchanger with low resistance and high efficiency are given.

8 Claims, 7 Drawing Figures

FIG_2
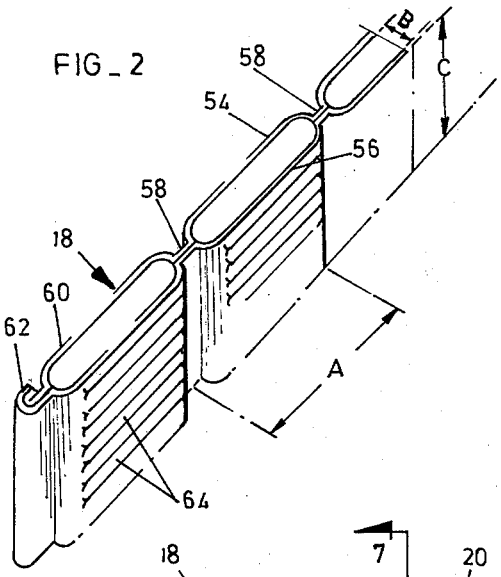
FIG_5
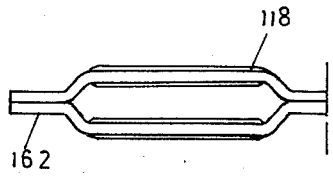
FIG_7
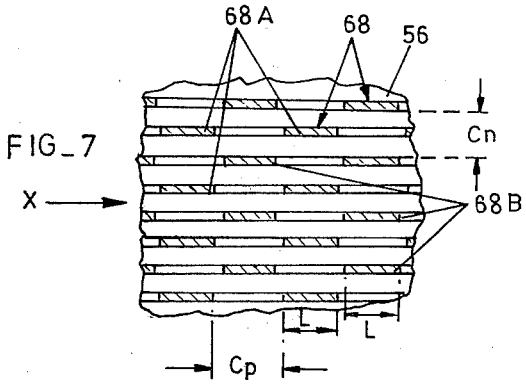
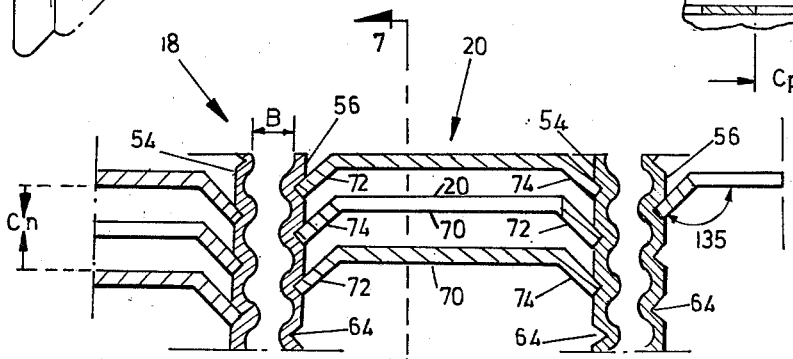
FIG_4
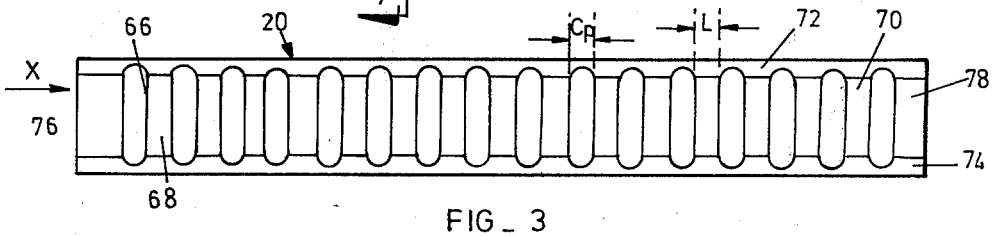
FIG_3
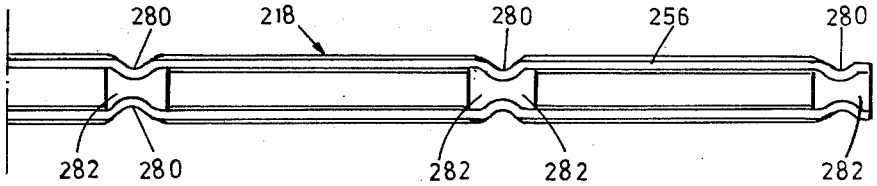
FIG_6

HEAT EXCHANGER WITH SLOTTED FIN STRIPS

BACKGROUND OF THE INVENTION

This invention relates to heat exchangers and particularly but not exclusively liquid-to-gas exchangers suitable for a variety of industrial purposes such as in dry-type natural-draught cooling towers of the kind commonly used in power stations in countries where water is scarce, and in the cooling of working places underground in deep-level mining.

An object of the invention is to provide a heat exchanger of this type which is assembled from a minimal number of basic components and which may yet be of substantial size and which lends itself to modular construction and assembly. These factors lead to relatively inexpensive manufacturing and installation costs and hence to superior economics, bearing in mind that in applications such as large modern cooling towers the cost of the heat exchangers is high.

A further object is to provide a fin-type heat exchanger which extensive testing has shown to be particularly and unexpectedly efficient, and to provide a range of parameters by which these results can be achieved.

In conventional heat exchangers of the type in question, the emphasis in the design has generally fallen either upon the lowering of the resistance to the passage of a fluid past the fins of the heat exchanger, thereby allowing large volumes of fluid to flow with no assistance from fans or with only a minimum of such assistance, or upon the opposed concept of maximising the heat transfer even at the expense of creating large-scale resistance to the flow of the fluid past the fins. Such resistance is commonly caused by excessive turbulence at the site of the fins.

The invention seeks to steer a different course to the extent that is based on the concept of utilising a controlled turbulence at the fins, so that laminar flow past the fins and the consequent build-up of heat transfer resistance in a stationary boundary layer is avoided but at the same time the resistance to flow is reduced to values which permit the passage of the fluid by natural flow in the case of a power station cooling tower or comparable installation.

With these objectives in view an extensive test program has been conducted on numerous types of heat exchanger to establish their characteristics, and in the course of these investigations it was discovered that there are certain critical relationships which, if present, lead to the optimised high-efficiency, low resistance features desired.

An initial phase of the test program gave rise to the filing of the Canadian patent application which has since been granted as Canadian Pat. No. 974,507, in which certain ranges of relationships were claimed.

The applicant has now discovered that the limits of the ranges in which the optimised performance mentioned earlier can be achieved are somewhat different from those disclosed in Canadian Pat. No. 974,507, and an object of this invention is to provide the parameters in this regard which the applicant has now established.

SUMMARY OF THE INVENTION

According to one aspect of the invention a heat exchanger comprises a series of conduits arranged adjacent each other but spaced apart and having opposed surfaces of substantial area, a series of substantially rectilinear grooves formed in each of the opposed surfaces so that each groove on one surface corresponds to a groove on an opposed surface, and a series of fins in the form of transversely slotted strips arranged in a stacked formation between adjacent conduits with the longitudinal edges of each fin extending into corresponding grooves in the opposed conduit surfaces, each fin having a substantially planar central longitudinal zone and two substantially planar longitudinal edge zones, the longitudinal edge zones each defining an obtuse included angle with the plane of the central longitudinal zone, both longitudinal edge zones lying on the same side of the plane of the central longitudinal zone.

In a preferred form, each longitudinal edge zone of a fin forms an included angle of substantially 135° with the plane of the central longitudinal zone. The fins are also preferably identical, and in one preferred version each fin has at one end a relatively wide transverse edge zone and at the other end a relatively narrow transverse edge zone, alternate fins in the series being displaced end-to-end in the stacked formation so that the slots in each fin are staggered relatively to those in its immediate neighbours but aligned with the slots in the similarly positioned fins. It is also preferred that the slots extend transversely across the full width of the central longitudinal zone.

Each conduit may conveniently be formed integrally with one or more other conduits arranged end-to-end to define a composite conduit panel, the grooves in all the conduits being aligned so that a single fin may be inserted in them and extend the full depth of the panel.

Another aspect ot the invention provides grooves on each of two opposite surfaces of the conduits, the grooves on one side being staggered relatively to those on the other side, the conduits having substantially constant wall thickness and the grooves being formed by bends in the conduit walls. The effect of this construction is that the passage along the interior of the conduit is sinuous but of substantially uniform width throughout the length of the conduit.

According to a further aspect of the invention, a heat exchanger comprises a series of conduits for a gas or a liquid that are spaced apart and define a series of substantially parallel planes, and fins located in the spaces between the conduits and adapted to be traversed by a gas, each fin extending between one conduit and an adjacent conduit and there being, between each two adjacent conduits, a first and a second set of fins, the fins of each set being aligned relatively to each other and staggered relatively to the fins of the other set both in the direction of the intended gas flow past the fins and also in a direction extending transversely to such direction of intended gas flow in a plane parallel to the planes defined by the conduits characterised in that:

L is in the range 2 to 10 mm;

$C_n/L$ is in the range 0.25 to 2; and $C_p/L$ is in the range 0.75 to 4;

where

L is the length of the cross-section of a fin, measured in the intended direction of gas flow past the fins;

$C_n$ is the distance in millimeters between adjacent aligned fins of the same set, measured transversely to the direction of intended gas flow past the fins in a plane parallel to the planes defined by the conduits; and $C_p$ is the distance in millimeters between consecutive aligned fins of the same set, measured in the direction of the intended gas flow past the fins.

In a preferred form, the values are:

L is substantially 7.5 mm;

$C_n/L$ is substantially 0.67; and $C_p/L$ is substantially 1.0.

These ranges and values have been established to be effective whether the fins are coils as described in the Canadian patent, or fins formed from strip material or for that matter certain other fin types.

BRIEF DESCRIPTION OF THE DRAWINGS

FIG. 2 is a fragmentary perspective view of a composite conduit panel in the heat exchanger of FIG. 1;

FIG. 3 is a plan view of a fin used in the heat exchanger of FIG. 1;

FIG. 4 is a sectional view of a part of the heat exchanger of FIG. 1;

FIG. 5 is a fragmentary plan view of an alternative composite conduit panel suitable for use with the invention;

FIG. 6 is a view similar to FIG. 5 of a further alternative composite conduit panel; and FIG. 7 is a simplified semi-schematic view along a vertical section (line 7—7 in FIG. 4) through a heat exchanger of the invention, taken in the space occupied by fins between two conduits and in a plane parallel to the planes defined by the surfaces of the two conduits.

DESCRIPTION OF A PREFERRED EMBODIMENT

Figure 1:
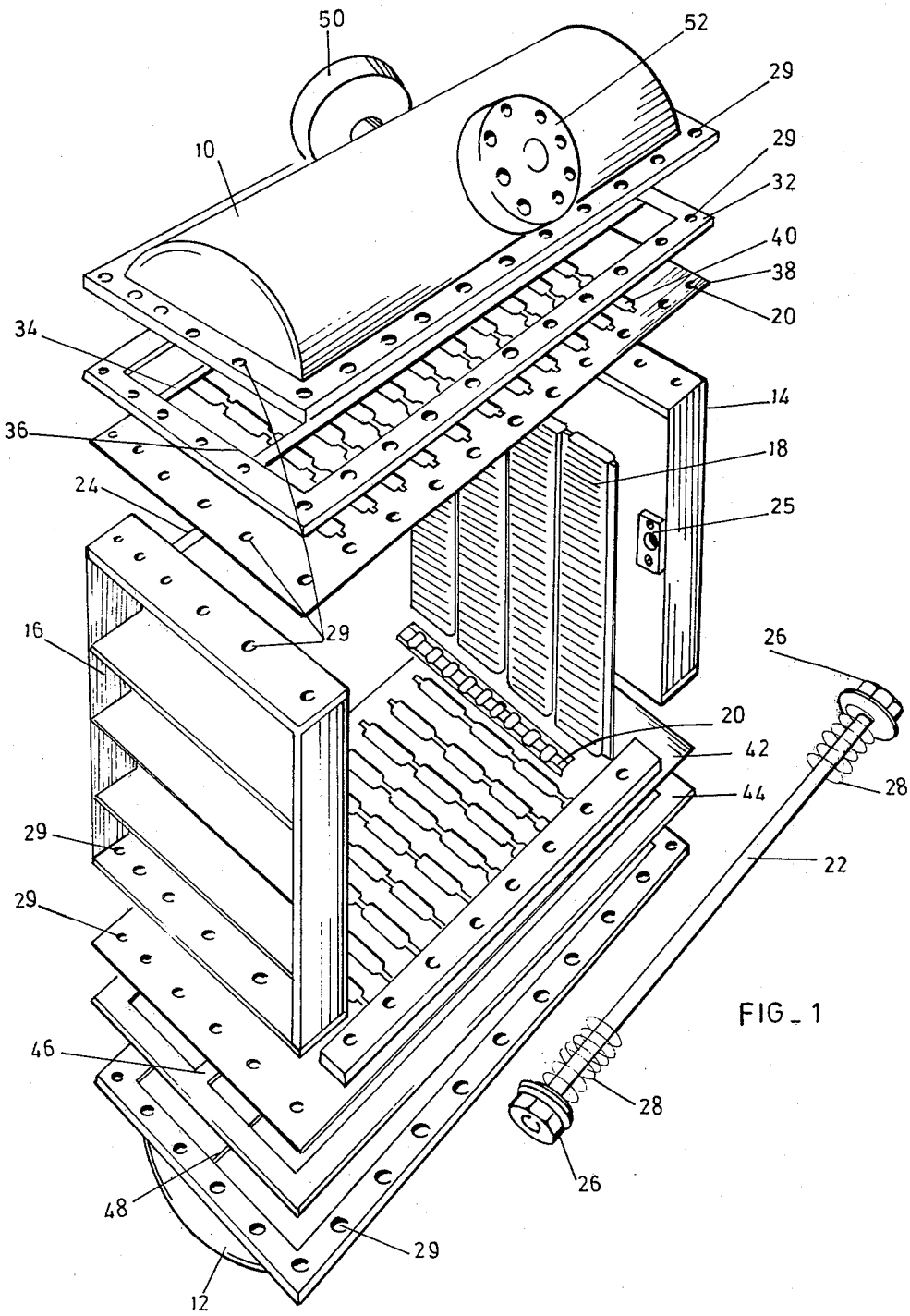
FIG. 1 is an exploded perspective view of the essential components of a heat exchanger of the invention.

In FIG. 1 a heat exchanger comprises an upper header 10, a lower header 12, and side frames 14, 16. Conduit panels 18 and fins 20 are held in compression between these components by pressure exerted through bars 22,24 extending between the frames 14,16 through brackets 25 and secured by nuts 26 and springs 28.

Adjacent the upper header 10 is a gasket 32 formed with two strips 34,36 that correspond to baffles (not illustrated) in the header 10 dividing the header chamber into three compartments. Below the gasket 32 is a tube plate 38 which is formed with perforations 40 each corresponding to the plan view profile of a conduit panel 18 and in which in practice the top of the conduit panel 18 is welded. Below the conduit panels 18 is a similar tube plate 42 in which the lower ends of the conduit panels are welded. Below the plate 42 is a gasket 44 which has a central strip 46 corresponding to a baffle 48 which divides the lower header 12 into two compartments. Bolts (not shown) are located through holes 29 at the upper and lower components to complete the assembly.

The upper header 10 is provided with an inlet adapter 50 and an outlet adapter 52.

The composite conduit panel 18 is seen on an enlarged scale in FIG. 2. It is formed from two sheets 54,56 of rolled steel of a thickness of approximately 1 mm having the appropriate profile, welded at seems 58. The profile is such that a series of flattened individual conduits 60 connected end-to-end results, separated by the seams 58 and having at each end zone of each panel a double folded seam 62. In a preferred form there are four individual conduits 60 in each panel, each conduit of some 65 mm in depth (the dimension "A" in FIG. 2) and with a transverse inner width (dimension "B") of 8 mm. The conduits have on each side surface a series of rectilinear grooves 64 formed by profiled rollers applied to the sheet 54 or 56 before it is welded. The grooves 64 extend transversely to the length (dimension "C") of the individual conduits 60. The dimension "C" may in practice conveniently be as long as 10 m.

Note that the outer side surfaces of the conduits 60 in each of the sheets 54,56 are of substantial area and a set of these surfaces in the panel defines a plane. The grooves 64 extend along such planes, each groove in each conduit 60 being aligned with a similar groove in the remaining three conduits of the panel.

A preferred fin 20 is seen in plan view in FIG. 3. It comprises a strip of mild steel of approximately 1 mm thickness in which transverse slots 66 are formed at regular intervals. The slots are approximately 7 mm wide (dimension $C_p$), equal in width to the individual fin elements, which are bodies 68 of material which remain between them (dimension L). The fin comprises a central longitudinal zone 70 of approximately 35 mm width and two longitudinal edge zones 72,74 each of approximately 10 mm width which are bent out of the plane of the flat central longitudinal zone 70 so that an included angle of approximately 135° (FIG. 4) is defined between each longitudinal edge zone and the longitudinal central zone. At one end of the fin is a wide transverse edge zone 76 (approximately 15 mm wide) and at the other end a narrow such zone 78 (approximately 7.5 mm wide). In the assembled heat exchanger the fins are located between opposed surfaces of two adjacent conduits 60 and are uniformly stacked one above the other in the grooves 64. The fins are also displaced through 180° (that is end-to-end) in alternate levels so that the wide edge zone 76 will be at one side of the heat exchanger as regards one fin and as regards its two neighbouring fins the narrow edge zones 78 will be at the same side. The effect of this construction is that the slots 66 are staggered relatively to each other in alternate fins throughout the length of the heat exchanger. The fin elements 68 thus form two sets 68A and 68B (FIG. 7), each set comprising the fin elements in alternate rows both vertically and along the horizontal length of the intended gas flow. In other words, the fin elements are staggered both in the intended direction of gas flow (arrow X in FIGS. 3 and 7) and in a direction transverse to the direction X. No other fins are present since they would tend to disturb the pattern of gas flow. When viewed along the direction X of intended gas flow, the fin elements 68 of both sets 68A and 68B are parallel to each other.

The slots 66 extend across the full width of the central longitudinal zone 70 and into the longitudinal edge zones 72,74.

In FIG. 4 it is seen that the longitudinal edge zones 72,74 of the fins 20 each extend into and abut against both surfaces of each groove 64 of the conduit panels 18, these grooves being V-shaped and subtending an angle of 90°. This establishes a close surface-to-surface contact between fin and conduit, which ensures good heat transfer. Heat transfer may be enhanced by galvanising, dipping, painting, lining or other means promoting contact between fin and conduit.

Note in FIG. 4 that the grooves 64 in the sheet 54 of each composite conduit panel 18 are staggered by half a pitch relatively to the grooves 64 in the sheet 56 of the same panel. This ensures that the passage defined down the length of the conduit is sinuous but is of substantially constant width (dimension "B") throughout its length.

Thus turbulence and mixing of the liquid is enhanced but abrupt and local pressure gradients arising from width changes are avoided.

The distances represented by L, $C_n$ and $C_p$ are indicated in FIGS. 3 and 7. The useful ranges and preferred values relating to L, $C_n/L$ and $C_p/L$ are as given above.

If L is substantially less than 2 mm, the scale of the fin arrangement becomes unduly small and manufacturing difficulties become considerable. There is also undue turbulence.

If L is substantially greater than 10 mm, a boundary layer of gas tends to form along it which is not displaced by the gas flow and the efficiency of heat removal diminishes.

If $C_n/L$ is substantially less than 0.25 there is considerable resistance to gas flow as the fins will be too tightly packed in the spaces between the conduits. If $C_n/L$ substantially exceeds the value 2, insufficient fin surface is provided to optimise the process of heat removal.

If $C_p/L$ is substantially below the value 0.75, there is not an efficient sweeping action of the gas flow in relation to the layer of gas nearest the surface of each fin and extending along its length L. If $C_p/L$ substantially exceeds 4, there is both minimised fin area and excessive turbulence, with the consequence that resistance to the gas flow rises unduly and the heat exchanger ceases to be of practical interest.

FIG. 5 shows an alternative end seaming arrangement for a conduit panel 118 in which the panel has at its ends a single seam connection 162 rather than the folded seam connection of FIG. 2.

In FIG. 6 a further alternative conduit panel construction is shown. The panel 218 illustrated comprises sheets 256,258 which have a series of longitudinal grooves 280 which fit into corresponding grooves in spacers 282 and which are welded to the spacers along such grooves.

The spacers 282 thus divide the interior of the panel into a series of individual conduits.

At the end of the panel there is a similar arrangement of a spacer 282 to which the ends of the panels 256,258 are welded along grooves 280.

The heat exchanger described above has several advantages over conventional structures.

Apart from the headers and frames and certain other ancillary components, there are only two basic component types, the composite conduit panel and the fin, and all components of each type may be identical, leading to large economies in manufacture and assembly.

By stacking the fins in the manner illustrated, i.e. so that they are uniformly arranged in that the longitudinal zones of each fin are parallel to the overlying and underlying zones of all the fins in the same vertical stack, the result is achieved that on tightening up the nuts 26 on the bars 22 to apply pressure to the assembly, any deformation caused in the structure takes the form of slight bowing of the central zone 70 of the fins. All the fins tend to bow to the same side so that there is no possibility that irregular bowing can occur, which might lead to interference between one fin and another and hence to a disturbance of the flow pattern of the gas around the fins.

The particular fin structure illustrated also has considerable flexibility to transverse forces and substantially all deformation caused by tensioning the nuts 26 on the bars 22 is taken up in the fins rather than in the conduits.

The fin profile is also simple to produce by conventional manufacturing techniques.

I claim:

1. A heat exchanger comprising a series of conduits for a gas or a liquid that are spaced apart and define a series of substantially parallel planes, and fin elements located in the spaces between the conduits and adapted to be traversed by a gas, each fin element extending between one conduit and an adjacent conduit and being in the form of a transversely slotted strip having a substantially planar central longitudinal zone and two substantially planar longitudinal edge zones, the longitudinal edge zones each defining an obtuse included angle with the plane of the central longitudinal zone with both longitudinal edge zones lying on the same side of the plane of the central longitudinal zone, there being, between each two adjacent conduits, a first and a second set of fin elements, the fin elements of each set being aligned relatively to each other and staggered relatively to the fin elements of the other set both in the direction of the intended gas flow past the fin elements and also in a direction extending transversely to the direction of intended gas flow past the fin elements in a plane parallel to the planes defined by the conduits, said heat exchanger further having a length L of the cross-section of a fin element measured in the intended direction of gas flow past the fins, a distance Cn in millimeters between adjacent aligned fin elements of the same set, measured transversely to the direction of intended gas flow past the fin elements in a plane parallel to the planes defined by the conduits, and a distance Cp in millimeters between consecutive aligned fin elements of the same set, measured in the direction of the intended gas flow past the fin elements, where:

L is in the range 2 to 10 mm;

Cn/L is in the range 0.25 to 2; and

Cp/L is in the range 0.75 to 4.

2. The heat exchanger of claim 1 wherein:

L is substantially 7.5 mm;

Cn/L is substantially 0.67; and

Cp/L is substantially 1.0.

3. The heat exchanger of claim 1 wherein each longitudinal edge zone forms an included angle of substantially 135° with the plane of the central longitudinal zone.

4. The heat exchanger of claim 1 wherein the slots extend transversely across the full width of the central longitudinal zone of the fin.

5. A heat exchanger comprising a series of conduits for a gas or a liquid that are arranged adjacent each other but spaced apart and having opposed surfaces of substantial area, a series of substantially rectilinear V-shaped grooves formed in each of the opposed surfaces so that each groove on one surface corresponds to a groove on an opposed surface, and fin elements in the form of transversely slotted strips located in the spaces between the conduits and adapted to be traversed by a gas, each fin element extending between one conduit and an adjacent conduit and having longitudinal edge zones which meet the surfaces of the conduits at an acute angle with the surface of the fin edge zone closest to the conduit lying along one limb of the V and the edge of the edge zone, being the thickness of the fin material, lying along the other limb of the V, and there being, between each two adjacent conduits, a first and a second set of fin elements, the fin elements of each set being aligned relatively to each other and staggered relatively to the fin elements of the other set both in the direction of the intended gas flow past the fin elements and also in a direction extending transversely to the direction of intended gas flow past the fin elements in a plane parallel to the planes defined by the conduits, said heat exchanger, further having a length L of the cross-section of a fin element measured in the intended direction of gas flow past the fins, a distance Cn in millimeters between adjacent aligned fin elements of the same set, measured transversely to the direction of intended gas flow past the fin elements in a plane parallel to the planes defined by the conduits, and a distance Cp in millimeters between consecutive aligned fin elements of the same set, measured in the direction of the intended gas flow past the fin elements, where:

L is in the range 2 to 10 mm;

Cn/L is in the range 0.25 to 2; and

Cp/L is in the range 0.75 to 4.

6. The heat exchanger of claim 5 wherein each conduit is formed integrally with one or more other conduits arranged end-to-end to define a composite conduit panel, the grooves in all the conduits of each panel being aligned along the width of the panel.

7. A heat exchanger comprising a series of conduits for a gas or a liquid that are spaced apart and define a series of substantially parallel planes, and fin elements in the form of transversely slotted strips arranged in a stacked formation in the spaces between the conduits and adapted to be traversed by a gas, each fin element extending between one conduit and an adjacent conduit and having at one end a relatively wide transverse edge zone and at the other end a relatively narrow transverse edge zone, alternate fins being arranged opposite ways round in the stacked formation so that the slots in each fin are staggered relatively to those in its immediate neighbours, but aligned with the slots in similarly positioned fins both in the direction of the intended gas flow past the fin elements and also in a direction extending transversely to the direction of intended gas flow past the fin elements in a plane parallel to the planes defined by the conduits, said heat exchanger further having a length L of the cross-section of a fin element between the slots measured in the intended direction of gas flow past the fins, a distance Cn in millimeters between similarly positioned fin elements measured transversely to the direction of intended gas flow past the fin elements in a plane parallel to the planes defined by the conduits, and a width Cp in millimeters of the slots in the fins measured in the direction of the intended gas flow past the fin elements, where:

L is in the range 2 to 10 mm;

Cn/L is in the range 0.25 to 2; and

Cp/L is in the range 0.75 to 4.

8. A heat exchanger comprising a series of conduits for a gas or a liquid that are arranged adjacent each other but spaced apart and have opposed surfaces of substantial area, a series of substantially rectilinear grooves formed in each of the opposed surfaces, so that each groove on one surface corresponds to a groove on an opposed surface, the grooves on one side of a conduit being staggered relatively to those on the other side so that the conduit passage is sinuous but of substantially constant width throughout the length of the conduit, and fin elements located in the spaces between the conduits and adapted to be traversed by a gas, each fin element extending between one conduit and an adjacent conduit and there being, between each two adjacent conduits, a first and a second set of fin elements, the fin elements of each set being aligned relatively to each other and staggered relatively to the fin elements of the other set both in the direction of the intended gas flow past the fin elements and also in a direction extending transversely to the direction of intended gas flow past the fin elements in a plane parallel to the planes defined by the conduits, said heat exchanger further having a length L of the cross-section of a fin element measured in the intended direction of gas flow past the fins, a distance Cn in millimeters between adjacent aligned fin elements of the same set, measured transversely to the direction of intended gas flow past the fin elements in a plane parallel to the planes defined by the conduits, and a distance Cp in millimeters between consecutive aligned fin elements of the same set, measured in the direction of the intended gas flow past the fin elements, where:

L is in the range 2 to 10 mm;

Cn/L is in the range 0.25 to 2; and

Cp/L is in the range 0.75 to 4.

* * * * *